US005127999A

United States Patent [19]

Klotz et al.

[11] Patent Number: 5,127,999

[45] Date of Patent: Jul. 7, 1992

[54] PROCESS FOR THE PREPARATION OF ALKALI METAL DICHROMATES AND CHROMIC ACID BY ELECTROLYSIS

[75] Inventors: Helmut Klotz, Bergisch Gladbach; Rainer Weber, Leverkusen; Norbert Lönhoff, Leverkusen; Hans-Dieter Block, Leverkusen; Hans D. Pinter, Pulheim, all of Fed. Rep. of Germany

[73] Assignee: Bayer Aktiengesellschaft, Leverkusen, Fed. Rep. of Germany

[21] Appl. No.: 713,625

[22] Filed: Jun. 10, 1991

Related U.S. Application Data

[63] Continuation of Ser. No. 496,754, Mar. 21, 1990, abandoned.

[30] Foreign Application Priority Data

Apr. 6, 1989 [DE] Fed. Rep. of Germany ..... 3911065

[51] Int. Cl.[5] ..... C25B 1/14; C25B 1/22

[52] U.S. Cl. ..... 204/89; 204/97; 204/103

[58] Field of Search ..... 204/59 R, 89, 97, 103

[56] References Cited

U.S. PATENT DOCUMENTS 3,305,463 2/1967 Carlin ..... 204/89
4,273,628 6/1981 Kidon et al. ..... 204/89

FOREIGN PATENT DOCUMENTS 2051868A 1/1981 United Kingdom .
2051869 1/1981 United Kingdom .

*Primary Examiner*—John Niebling
*Assistant Examiner*—Kathryn Gorgos
*Attorney, Agent, or Firm*—Sprung, Horn, Kramer & Woods

[57] ABSTRACT

A process for the preparation of alkali metal dichromates and/or chromic acid by electrolysis of alkali metal monochromate and/or alkali metal dichromate solution in electrolysis cells, the anode and cathode compartments of which are separated by cation exchange membranes, wherein the cation exchange membranes are single-layer membranes based on perfluorinated polymers having sulfonic acid groups as cation exchange groups, and an aqueous solution having a pH of 4 to 14 is produced in the cathode compartment of the cells.

3 Claims, 1 Drawing Sheet

PROCESS FOR THE PREPARATION OF ALKALI METAL DICHROMATES AND CHROMIC ACID BY ELECTROLYSIS

This application is a continuation of application Ser. No. 496,754, filed Mar. 21, 1990, now abandoned.

BACKGROUND OF THE INVENTION

1. Field of the Invention

The invention relates to a process for the preparation of alkali metal dichormates and chromic acid by electrolysis of alkali metal monochromate and/or alkali metal dichromate solutions in electrolysis cells, the anode and cathode compartments of which are separated by cation exchange membranes.

2. Description of Related Art

According to U.S. Pat. No. 3,305,463 and CA-A-739,447, the electrolytic preparation of alkali metal dichromates and chromic acid is carried out in electrolysis cells, the electrode compartments of which are separated by cationic exchange membranes. In the production of sodium dichromate, sodium monochromate solutions or suspensions are passed into the anode compartment of the cell and converted into a sodium dichromate solution by selectively transferring sodium ions through the membrane into the cathode compartment. For the preparation of chromic acid, sodium dichromate or sodium monochromate or a mixture of sodium dichromate and sodium monochromate is passed into the anode compartment and converted into the solution containing chromic acid. In both processes, an aqueous solution of sodium hydroxide is obtained in the cathode compartment.

Membranes which are sufficiently chemically, thermally and mechanically stable and based on perfluorinated polymers having exchanger groups are preferably used as cation exchange membranes in the stated processes. These membranes may have both a single-layer structure and a two-layer structure, the two-layer membranes as a rule more effectively suppressing the diffusion of hydroxide ions through the membrane, which leads to a higher current efficiency of the electrolysis. However, this improved current efficiency is generally associated with a higher cell voltage than that achieved with the use of single-layer membranes.

Such cation exchange membranes are described in, for example, H. Simmrock, E. Griesenbeck, J. Jörissen and R. Rodermund, Chemie-Ing. Techn. 53 (1981), No. 1, pages 10 to 25 and are commercially available, for example, under the name Nafion$^R$ (manufacturer: E. I. DuPont De Nemours & Co., Wilmington, Del./USA).

In addition to the lower cell voltage achievable, single-layer membranes have the advantage that, compared with two-layer membranes, they are less sensitive to polyvalent cations, in particular calcium ions and strontium ions, in the alkali metal chromate and/or alkali metal dichromate solutions, which lead to precipitation of polyvalent cation compounds in the membrane and consequently to a deterioration in the functioning of the membrane.

The object of the invention is to provide a process for the preparation of alkali metal dichromates and chromic acid, which process does not have the disadvantages described.

SUMMARY OF THE INVENTION

It has now been found that the preparation of alkali metal dichromates and chromic acid can be carried out particularly advantageously by electrolysis if single-layer membranes having sulphonic acid groups are used as cation exchange membranes and an aqueous solution containing alkali metal ions and having a pH of 4 to 14 is produced in the cathode compartment of the electrolysis cells.

The invention thus relates to a process for the preparation of alkali metal dichromates and/or chromic acid by electrolysis of alkali metal monochromate and/or alkali metal dichromate solutions in electrolysis cells, the anode and cathode compartments of which are separated by cation exchange membranes, which is characterised in that the cation exchange membranes are single-layer membranes based on perfluorinated polymers having sulphonic acid groups as cation exchange groups, and an aqueous solution having a pH of 4 to 14 is produced in the cathode compartment of the cells.

DESCRIPTION OF THE PREFERRED EMBODIMENTS

Figure 1:
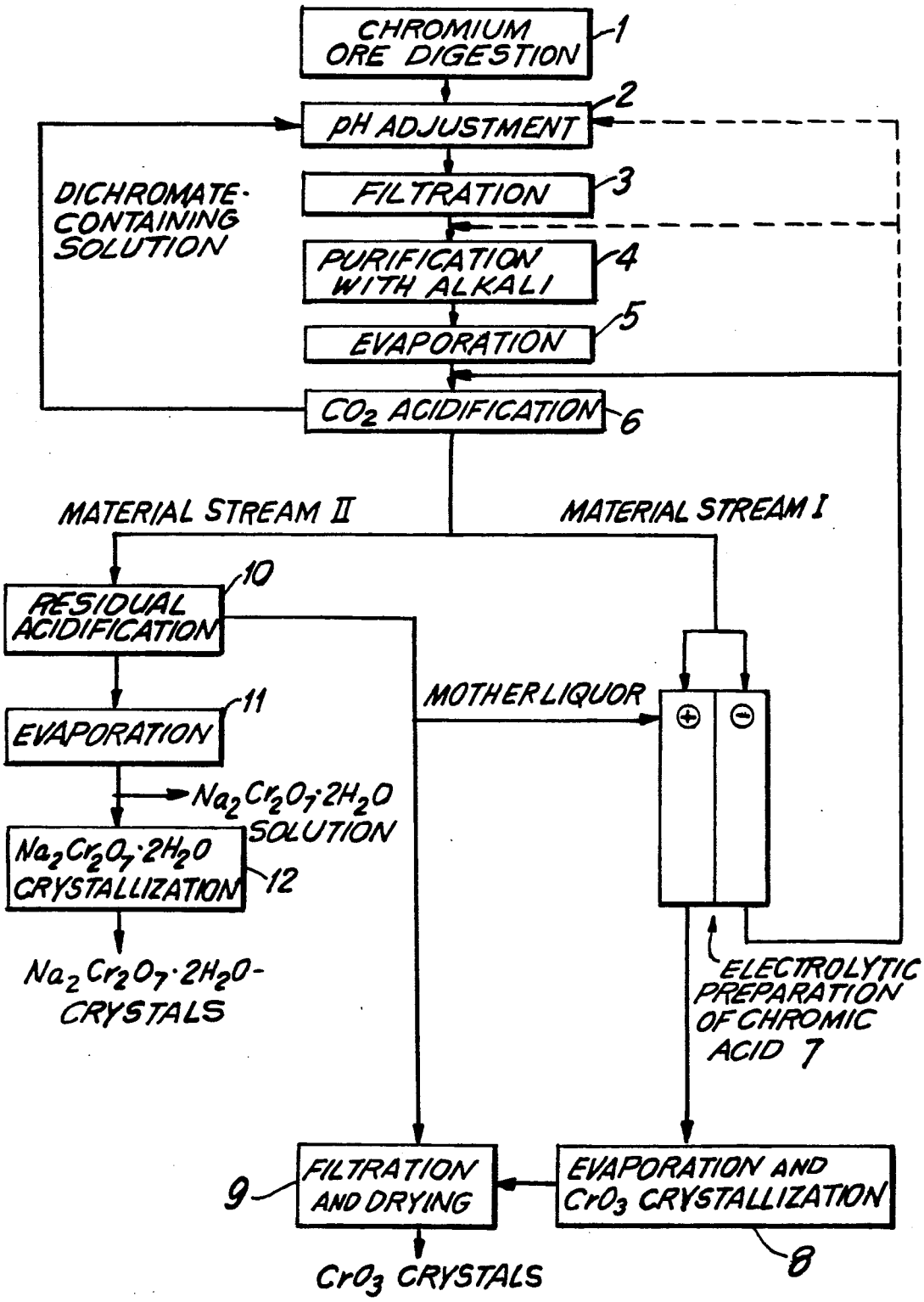
FIG. 1 is a flow-sheet illustrating the process according to the present invention.

The aqueous solution preferably consists of a solution containing alkali metal monochromate and/or alkali metal dichromate, preferably of a solution containing sodium monochromate and/or sodium dichromate. Such solutions are obtained by feeding to the cathode compartment of the cells a solution which contains an alkali metal dichromate and may also contain amounts of alkali metal monochromate or chromic acid. It is advantageous to feed to the cathode compartment a solution which contains alkali metal chromate and in which 70 to 95% of the chromate ions are present as dichromate ions and 5 to 30% are present as monochromate ions. Such solutions are obtained, for example, in the preparation of sodium dichromate solution from sodium monochromate solution by acidification with carbon dioxide under pressure.

The aqueous solution may also consist of a solution which contains sodium carbonate and which may also contain amounts of sodium hydroxide or sodium bicarbonate. Such solutions are obtained by feeding water or dilute solution containing sodium ions to the cells and adding carbon dioxide to the solution of the cathode compartment, inside or outside the said compartment. In a particularly preferred variant of the process according to the invention, an aqueous solution containing sodium dichromate and having a pH of 6 to 7.5 is produced in the cathode compartment.

In carrying out the process according to the invention, current efficiencies are obtained which are comparable to those obtained when two-layer membranes are used and which cannot be achieved under the working conditions proposed to date. However, the cell voltages are substantially lower than in the electrolysis in cells the electric compartments of which are separated by a two-layer membrane. Precipitation of compounds of polyvalent cations in the membrane is avoided, with the result that the life of the membrane is considerably prolonged, ensuring continuous and permanent operation of the electrolysis.

The process according to the invention is illustrated in more detail in FIG. 1. The variant of the process according to the invention which is described in FIG. 1 represents a particularly advantageous embodiment.

Chromium ore is digested by alkaline oxidative treatment with sodium carbonate and atmospheric oxygen at 1000° to 1100° C. in the presence of a flowability agent in a rotary kiln (1). The furnace clinker formed is then leeched with water or dilute chromate solution and adjusted to a pH of between 7 and 9.5 with a solution containing sodium dichromate (2). During this procedure, soluble alkali metal compounds of iron, of aluminum and of silicon are converted into insoluble and readily filterable hydroxides or hydrated oxides, which are separated off together with the insoluble constituents of the furnace clinker (3). The resulting sodium monochromate solution having a content of 300 to 500 g/l of $Na_2CrO_4$ can then, as described in EP-A-47 799, be freed from dissolved vanadate by the addition of calcium oxide at pH values of 10 to 13.

The sodium monochromate solution is then adjusted to contents of 750 to 1000 g/l of $Na_2CrO_4$ by single-stage or multistage evaporation (5). The sodium monochromate solution can optionally be freed from the major part of alkaline earth metal ions and other polyvalent cations prior to the evaporation (5) by precipitation as carbonates, by the addition of, or in situ production of, sodium carbonate. The precipitation is preferably carried out at temperatures of 50° to 100° C., at pH values between 8 and 12 and with an approximately 2-fold to 10-fold molar carbonate excess, relative to the amount of alkaline earth metal ions.

The pH of the solution, which is now concentrated, is adjusted to below 6.5 by a single-stage or multistage introduction of carbon dioxide to a final pressure of 4 to 15 bar at a final temperature which does not exceed 50° C., and 70 to 95% conversion of the sodium chromate into sodium dichromate is achieved in this manner with precipitation of sodium bicarbonate (6).

The sodium bicarbonate is separated off from the resulting suspension while maintaining the carbon dioxide pressure, or, after the pressure has been let down, the sodium bicarbonate is separated off rapidly before its reverse reaction with the sodium dichromate.

The sodium bicarbonate which has been separated off is converted into sodium carbonate by thermal treatment, optionally after the addition of sodium hydroxide solution, and the sodium carbonate is used in the chromium ore digestion (1).

The resulting sodium monochromate/sodium dichromate solution separated off from the sodium bicarbonate is now divided into two material streams, after removal of a bleed stream for pH adjustment of the leeched furnace clinker. Material stream I is fed to the electrolytic preparation of chromic acid, and material stream II is fed to the preparation of sodium dichromate solutions and sodium dichromate crystals.

For the electrolytic preparation of chromic acid, material stream I is divided into two part streams and fed to the anode and cathode compartments of two-compartment electrolysis cells having single-layer membranes as partitions (7). Suitable single-layer membranes are, for example, Nafion$^R$ 117, Nafion$^R$ 417, Nafion$^R$ 423 and Nafion$^R$ 430, the active exchange groups of which are sulphonic acid.

The single-layer membranes may also have coverings which reduce the adhesion of gas bubbles or promote wetting of the membrane with electrolyte. Such membranes are described in, for example, F. Y. Masuda, J. Appl. Electrochem. 16 (1986), page 317 et seq.. Membranes having reduced adhesion of gas bubbles are also obtainable by a physical treatment, such as, for example, mechanical roughening or corona treatment. Appropriate processes are described in U.S. Pat. No. 4,610,762 and EP-A-72 485.

The electrolysis is preferably carried out as a multistage process: a part stream of material stream I is introduced into the anode compartment of the first stage and, after partial conversion of the monochromate ions to dichromate ions and optionally chromic acid or after partial conversion of the dichromate ions into chromic acid, is then fed to further stages, which effect partial further conversion into chromic acid, until a conversion of dichromate into chromic acid of 55 to 70%, corresponding to a molar ratio of sodium ions to chromic acid of 0.45:0.55 to 0.30:0.70, is achieved in the final stage. Any number of stages may be chosen, a 6-stage to 15-stage electrolysis being preferred.

The other part stream of material stream I, optionally after mixing with a part stream of the sodium chromate solution and before evaporation to 750 to 1000 g/l, is passed into all cathode compartments of the electrolysis cells at a rate such that the resulting pH of the solution leaving the cells is 6 to 7.5. This solution containing sodium dichromate and sodium monochromate is fed to the carbon dioxide acidification (6), optionally after concentration, the monochromate ions formed being converted again into dichromate ions. It is also possible to recycle the solution from the cathode compartments to another point in the process, such as, for example, to the pH adjustment (2) or upstream of the purification with alkali (4).

The solution formed in the electrolysis and containing chromic acid and residual sodium dichromate is brought to a water content of about 12 to 22% by weight at temperatures between 55° and 110° C. by evaporation, the predominant part of the chromic acid crystallizing out (8) The suspension formed is then separated by centrifuging at 50° to 110° C. into a solid essentially consisting of crystalline chromic acid and into a liquid phase, referred to below as mother liquor (9).

The mother liquor obtained, optionally after dilution with water, is recycled to the electrolysis at a suitable point, that is to say to a stage having as similar a dichromate conversion as possible. To avoid a high degree of accumulation of impurities in the system, some of the mother liquor is removed and is used in the residual acidification of material stream II or, if a material stream II has not been removed, is recycled to the sodium dichromate process at a point upstream of the purification of the sodium chromate solution, for example to the pH adjustment (2). The crystalline chromic acid is freed from adhering mother liquor by washing once or several times with 10 to 50% by weight, relative to the weight of the solid, of saturated or virtually saturated chromic acid solution and by centrifuging after each wash process. The washed pure chromic acid crystals can now be used directly or after drying.

For the preparation of sodium dichromate solutions and crystals, the solution of material stream II is fed to the residual acidification (10). As mentioned above, this residual acidification is carried out using mother liquor from the chromic acid filtration (9). However, it can also be carried out partly or completely by electrolysis and/or by addition of sulfuric acid.

The solution obtained after the residual acidification (10) is then evaporated to about 60 to 70% by weight of $Na_2Cr_2O_7 . 2H_2O$ to produce sodium dichromate solution. For the preparation of sodium dichromate crystals, the solution is evaporated to about 1650 g/l of $Na_2Cr_2O_7 . 2H_2O$ (11) and then cooled to 30° to 40° C. (12), sodium dichromate being precipitated in the form of $Na_2Cr_2O_7 . 2H_2O$ crystals. Crystals are then separated from the mother liquor by centrifuging and are dried at temperatures of about 70° to 85° C.

The Examples which follow are intended to illustrate the process according to the invention.

EXAMPLES

The electrolysis cells used in the Examples consisted of anode compartments of pure titanium and cathode compartments of stainless steel. Cation exchange membranes from DuPont, designated Nafion$^R$ 324 and Nafion$^R$ 430, were used as membranes, Nafion$^R$ 324 being a two-layer membrane and Nafion$^R$ 430 being a single-layer membrane.

The cathodes consisted of stainless steel and the anodes of titanium with the electrocatalytically active coatings mentioned in the individual Examples. The distance from the electrodes to the membrane was 1.5 mm in all cases. Sodium dichromate solutions containing 800 g/l of $Na_2Cr_2O_7 . 2H_2O$ were passed into the anode compartments. The rate of introduction was chosen so that the resulting molar ratio of sodium ions to chromium(IV) in the anolyte leaving the cells was 0.6.

In the cathode compartment of the cells, either sodium hydroxide solution or a solution containing sodium chromate was produced.

The electrolysis temperature was 80° C. in all cases and the current density was 3 kA/m$^2$ of projected front area of the anodes and cathodes, this area being 11.4 cm×6.7 cm.

EXAMPLE 1

In this Example, the single-layer membrane Nafion$^R$ 430 was used for separating the anode compartment and cathode compartment. The anode was a titanium anode with an electrocatalytically active layer containing iridium oxide, as described in, for example, U.S. Pat. No. 3,878,083.

Water was fed into the cathode compartment at a rate such that 10% strength sodium hydroxide solution left the cell.

During an electrolysis time of 61 days, the resulting mean cell voltage was 4.2 volt. The mean current efficiency during this period was 38%.

After the end of the experiment, a sodium dichromate solution containing 800 g/l of $Na_2Cr_2O_7 . 2H_2O$ was fed to the cathode compartment, instead of water. The rate of introduction was adjusted so that the catholyte leaving the cell had a pH of 6.5 to 7.0. An unchanged mean cell voltage of 4.2 volt resulted during the experimental period of 9 days. The current efficiency increased to an average value of 63%.

By producing a chromate-containing catholyte instead of sodium hydroxide solution, the current efficiency was accordingly considerably increased, the cell voltage remaining the same.

EXAMPLES 2, 3, 4 AND 5

In these Examples, titanium anodes having a platinum layer produced by melt galvanization were used, as described in G. Dick, Galvanotechnik 79 (1988), No. 12, pages 4066–4071.

The two-layer membrane Nafion$^R$ 324 was used in Examples 2 and 3 and the single-layer membrane Nafion$^R$ 430 was used in Examples 4 and 5.

The following were produced as catholytes:

Example 2: 20% strength sodium hydroxide solution by feeding water to the cathode compartment.

Example 3 and 4: Chromate-containing solutions having a mean pH of 6.5 by feeding sodium dichromate solution containing 800 g/l of $Na_2Cr_2O_7 . 2H_2O$.

Example 5: Chromate-containing solution having a mean pH of 13.4 by feeding sodium dichromate solution containing 600 g/l of $Na_2Cr_2O_7 . 2H_2O$.

The results of the experiments are summarized in Table 1.

As shown in Table 1, a substantially lower cell voltage is achieved at a high current efficiency by using a single-layer membrane instead of a two-layer membrane and producing chromate-containing catholyte.

TABLE 1

| Example | Membrane | Catholyte | Mean cell voltage | Mean current efficiency | Experimental time |
|---|---|---|---|---|---|
| 2 | Nafion$^R$ 324 | 20% strength sodium hydroxide solution | 4.9 volt | 56% | 100 days |
| 3 | Nafion$^R$ 324 | Chromate-containing solution, pH 6.5 | 5.2 volt | 65% | 100 days |
| 4 | Nafion$^R$ 430 | Chromate-containing solution, pH 6.5 | 4.7 volt | 64% | 100 days |
| 5 | Nafion$^R$ 430 | Chromate-containing solution, pH 13.4 | 4.5 volt | 62% | 100 days |

What is claimed is:

1. A process for the preparation of alkali metal dichromates, chromic acid, or a mixture of alkali metal dichromates and chromic acid in a two-chamber electrolytic cell comprising anode and cathode chambers that are separated by a single-layer cation exchanger membrane based on perfluorinated polymers having sulfonic acid groups as cation exchanger groups, said process comprising (1) introducing alkali metal monochromate solutions, alkali metal dichromate solutions, or a mixture of alkali metal monochromate solutions and alkali metal dichromate solutions into the anode chamber and electrolyzing said solutions to form an anolyte containing alkali metal dichromate, chromic acid, or a mixture of alkali metal dichromate and chromic acid in the anode chamber and (2) introducing alkali metal monochromate solutions, alkali metal dichromate solutions, or a mixture of alkali metal monochromate solutions and alkali metal dichromate solutions into the cathode chamber to produce a chromate-containing aqueous catholyte having a pH of 4 to 14 in the cathode chamber.

2. A process according to claim 1, wherein the aqueous solution is a solution containing sodium monochromate or sodium dichromate or a mixture thereof.

3. A process according to claim 1, wherein the pH of the aqueous solution containing sodium dichromate is 6 to 7.5.

* * * * *